US005718645A

United States Patent [19]

Chang

[11] Patent Number: 5,718,645

[45] Date of Patent: Feb. 17, 1998

[54] FACE PANEL MOUNTING STRUCTURE FOR A GOLF CLUB HEAD

[76] Inventor: Teng Ho Chang, 3, Alley 77, Lane 381 Chungcheng S. Road, Tianan, Taiwan

[21] Appl. No.: 845,554

[22] Filed: Apr. 24, 1997

[51] Int. Cl.[6] ..... A63B 53/04

[52] U.S. Cl. ..... 473/342

[58] Field of Search ..... 473/324, 329, 473/332, 342, 347, 348, 349, 350, 288, 282

[56] References Cited

U.S. PATENT DOCUMENTS

| | | | |
|---|---|---|---|
| 3,567,228 | 3/1971 | Lynn | 473/332 |
| 4,884,808 | 12/1989 | Retzer | 473/342 |
| 5,106,094 | 4/1992 | Desbiolles et al. | 473/342 |
| 5,261,664 | 11/1993 | Anderson | 473/342 |
| 5,405,137 | 4/1995 | Vincent et al. | 473/342 |
| 5,509,660 | 4/1996 | Elmer | 473/342 |

*Primary Examiner*—Sebastiano Passaniti
*Attorney, Agent, or Firm*—Pro-Techtor International

[57] ABSTRACT

A face panel mounting structure for a golf club head, including a face panel, two wave-shaped metal binding strips and a M-shaped metal binding strip and a binding frame respectively welded to the face panel at its back and defining a plurality of open spaces into which molten aluminum alloy is filled when molding a casing for golf club head on the face panel.

1 Claim, 7 Drawing Sheets

FACE PANEL MOUNTING STRUCTURE FOR A GOLF CLUB HEAD

BACKGROUND OF THE INVENTION

The present invention relates to a face panel mounting structure for a golf club head, and more particularly to such a face panel mounting structure which can be easily integrally mounted on the club head casing during the molding of the club head casing.

The game of golf has become more and more popular nowadays. When playing the game of golf, different golf clubs may be used. A fold club is generally comprised of a club head and a shaft. FIG. 1 shows a golf club head according to the prior art. This structure of golf club head comprises a face panel 100 and a club head casing 200 molded on the face panel 100. The face panel 100 has two locating rods 101 at two opposite sides for positioning (see FIG. 2). After molding, the locating rods 101 must be cut off and ground. This cutting and grinding procedures complicate the fabrication process of the golf club head. Furthermore, because the face panel 100 and the club head casing 200 are made from different materials, the remainder of the locating rods 101 obstructs the unity of the quality of the club head casing 200. FIGS. 3 and 4 show another structure of golf club head according to the prior art in which the face panel 300 is directly adhered to the front recess 401 of the club head casing 400. Because the face panel 300 is fastened to the club head casing 400 by an adhesive, the binding force between the face panel 300 and the club head casing 400 tends to be destroyed by impact force, causing the face panel 300 to fall from the club head casing 400.

SUMMARY OF THE INVENTION

The present invention has been accomplished to provide a face panel mounting structure which eliminates the aforesaid drawbacks. According to the present invention, the face panel mounting structure comprises a face panel having an endless groove at its back side around the border, two wave-like metal binding strips and a M-shaped metal binding strip and a binding frame respectively welded to the face panel at its back and defining a plurality of open spaces. During the fabrication of the golf club head, the club head casing is directly molded on the face panel, permitting molten aluminum alloy to fill up the endless groove of the face panel and the open spaces defined between the face panel, the wave-like metal binding strips, the M-shaped metal binding strip and the binding frame.

DETAILED DESCRIPTION OF THE PREFERRED EMBODIMENT

Figure 1:
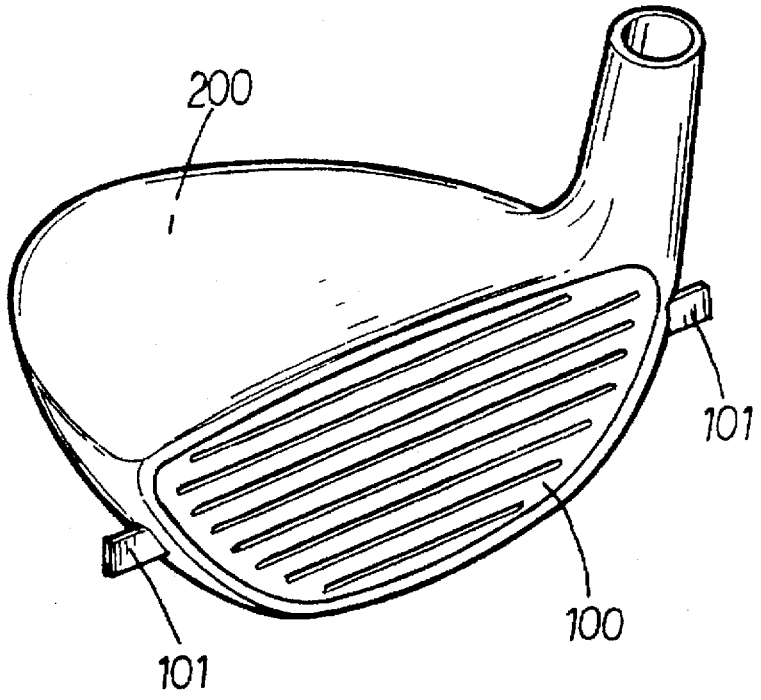
FIG. 1 (Prior Art)
FIG. 1 is an elevational view of a golf club head according to the prior art.
Figure 2:
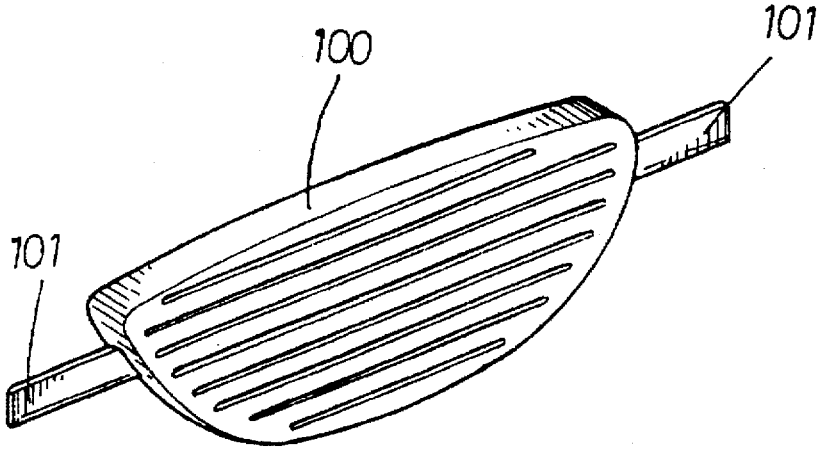
FIG. 2 (Prior Art)
FIG. 2 is an elevational view of the face panel for the golf club head shown in FIG. 1.
Figure 3:
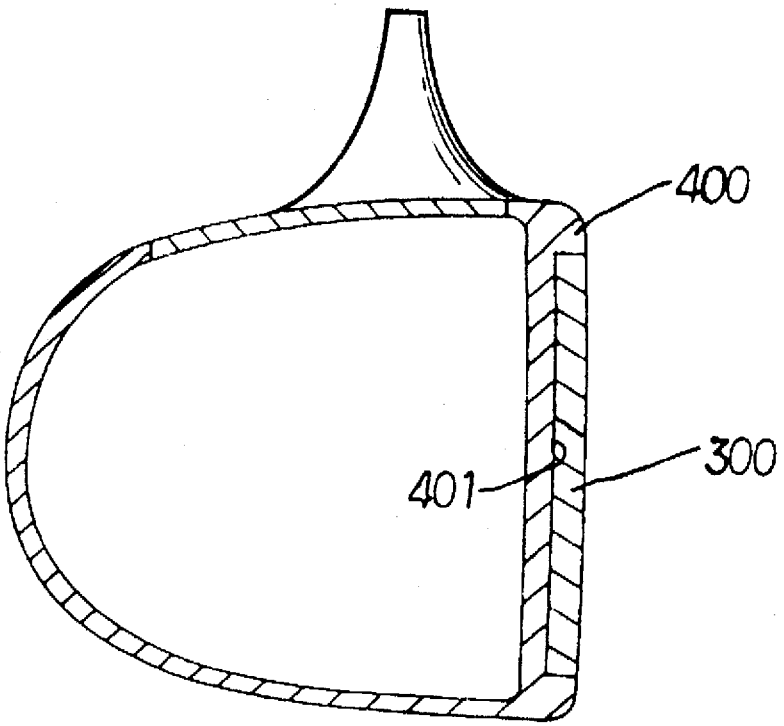
FIG. 3 (Prior Art)
FIG. 3 is a sectional view of another structure of golf club head according to the prior art.
Figure 4:
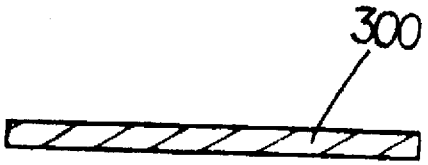
FIG. 4 (Prior Art)
FIG. 4 is a sectional view of the face panel for the golf club head shown in FIG. 3.
Figure 5:
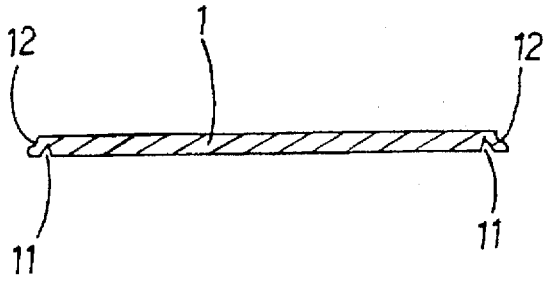
FIG. 5 is a sectional view of a face panel for a golf club head according to the present invention.
Figure 6:
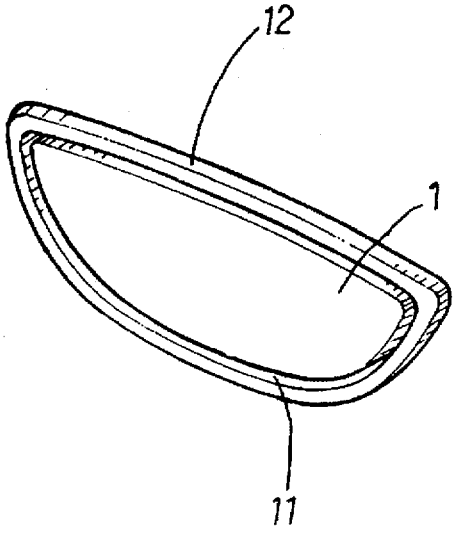
FIG. 6 is an elevational back side view of the face panel shown in FIG. 5.

Referring to FIGS. 5 and 6, a face panel 1 is made from a titanium plate by stamping, having an endless groove 11 at its back side around the border and defining a border flange 12.

Figure 7:
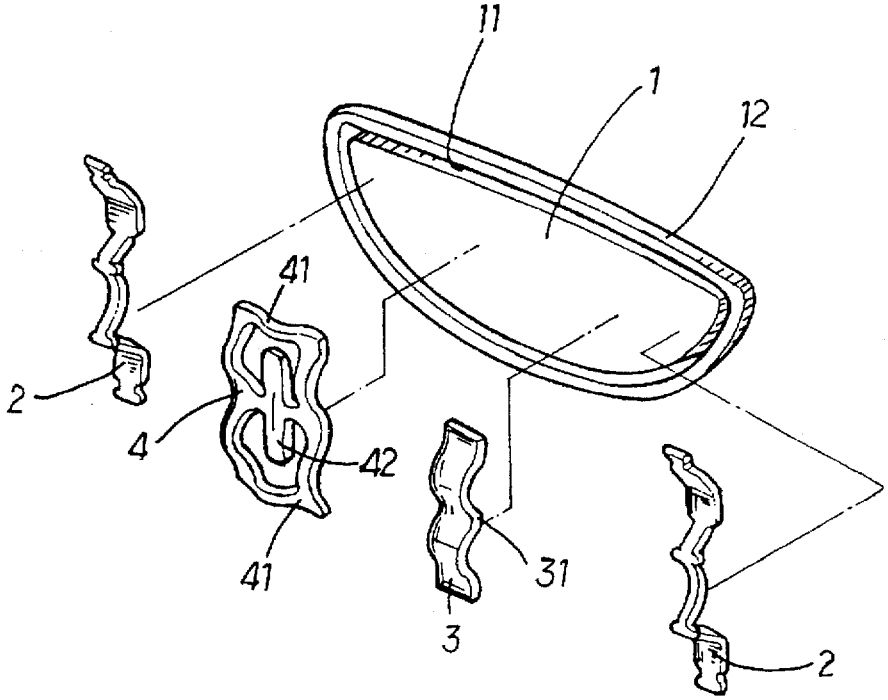
FIG. 7 is an exploded view of the face panel, the wave-like metal binding strips, the M-shaped metal binding strip and the binding frame according to the present invention.
Figure 8:
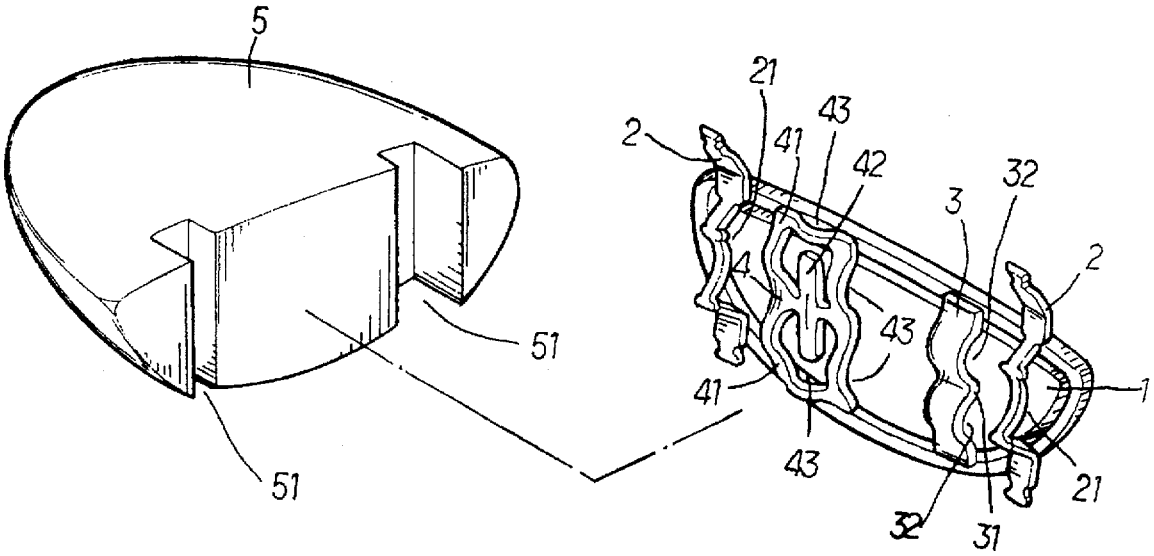
FIG. 8 shows the wave-like metal binding strips, the M-shaped metal binding strip and the binding frame welded to the face panel, and the positioning of the present invention on the sand core.
Figure 9:
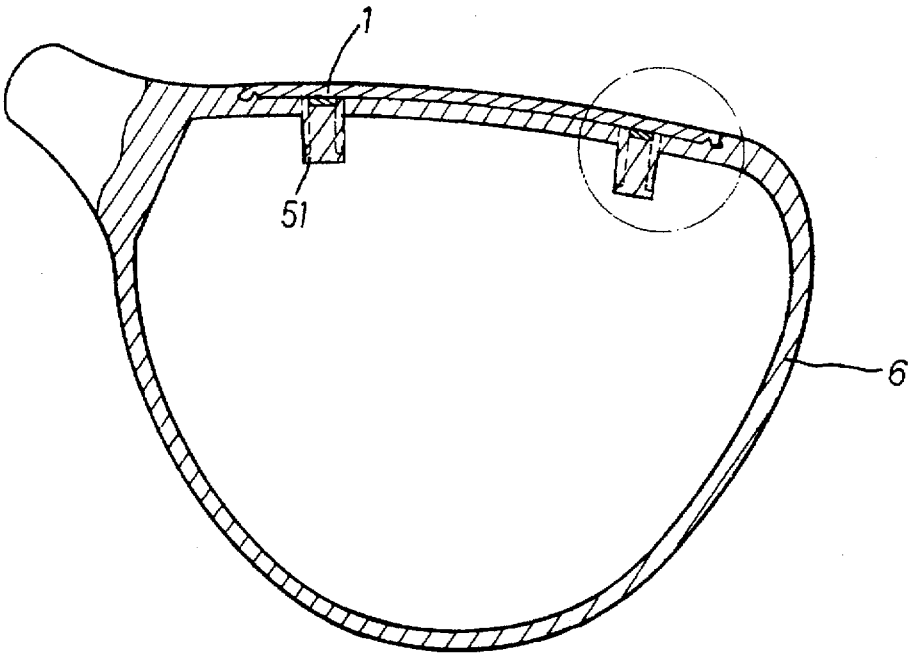
FIG. 9 is a sectional view showing a club head casing molded on the face panel according to the present invention.
Figure 9A:
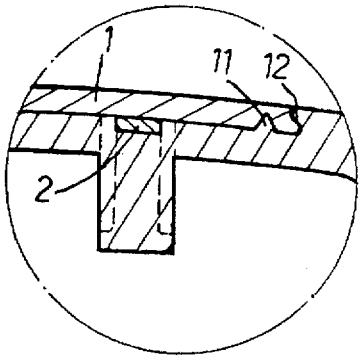
FIG. 9A is a sectional view in an enlarged scale of a part of FIG. 9.
Figure 10:
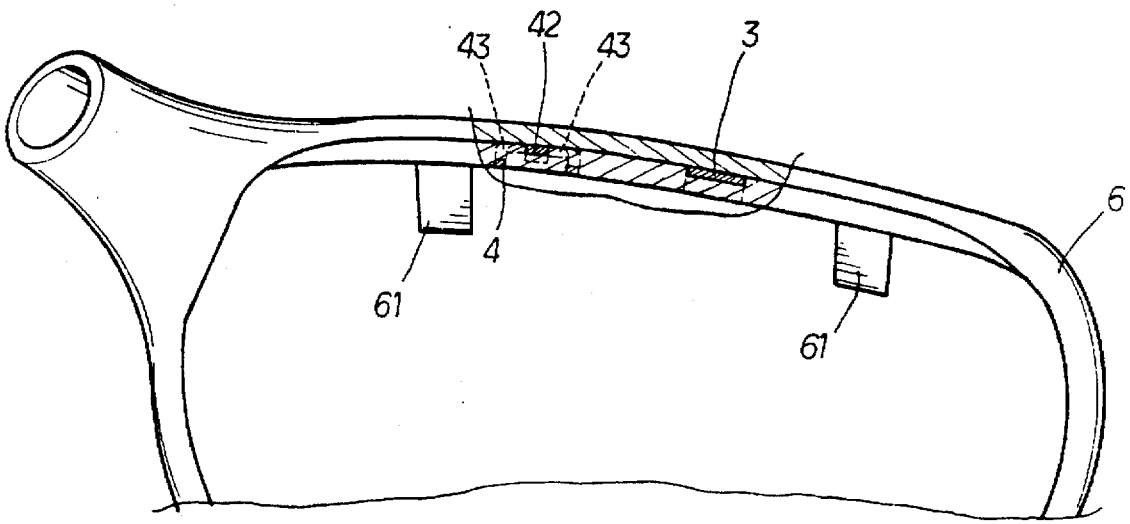
FIG. 10 is an enlarged view of FIG. 9, showing the open spaces filled up with aluminum alloy.
Figure 11:
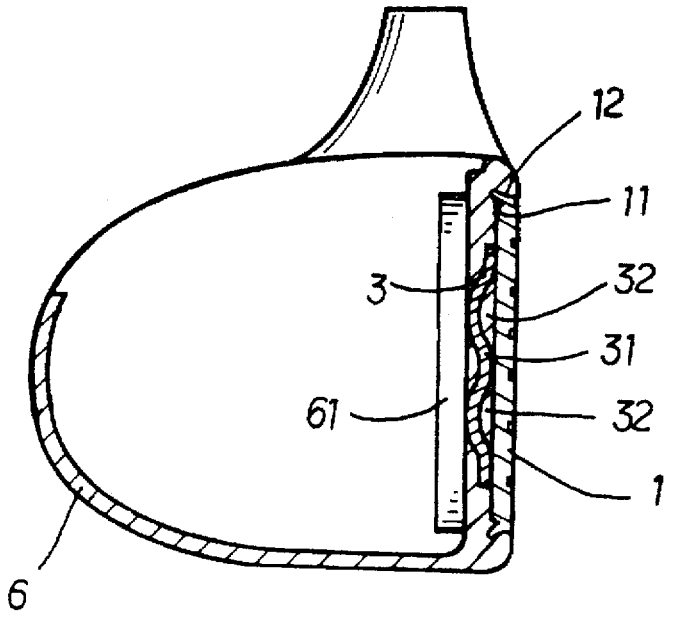
FIG. 11 is another sectional view showing the connection between the face panel and the club head casing according to the present invention.
Figure 12:
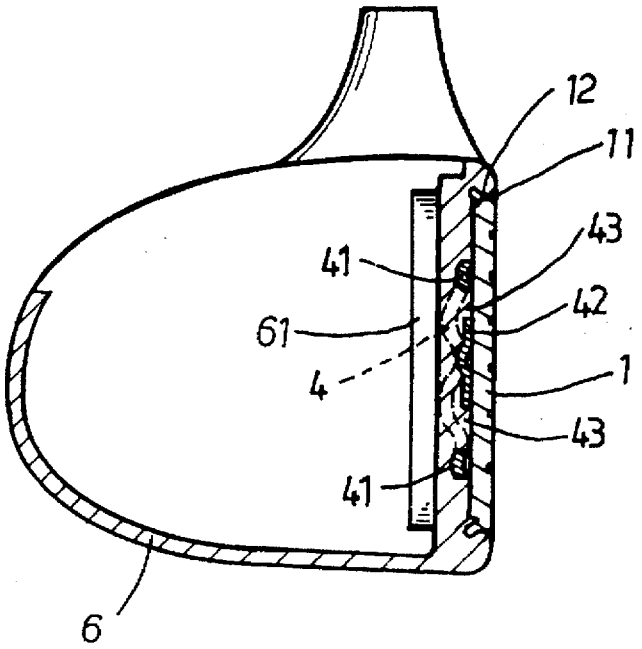
FIG. 12 is still another sectional view showing the connection between the face panel and the club head casing according to the present invention.
Figure 13:
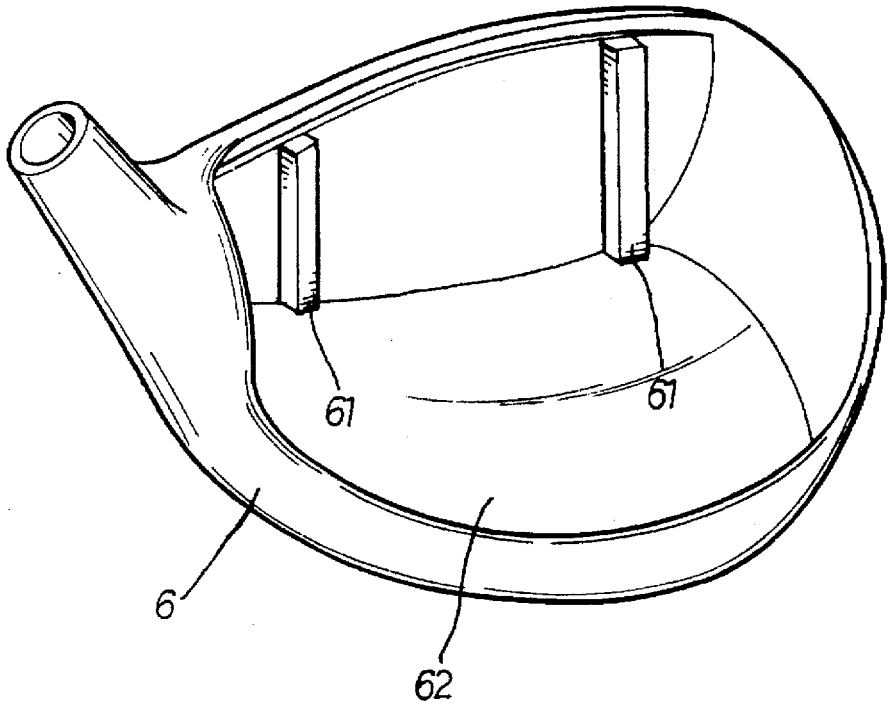
FIG. 13 is an elevational view of the club head casing according to the present invention.

Referring to FIGS. 7 and 8, two wave-like metal binding strips 2, a M-shaped metal binding strip 3 and a binding frame 4 are vertically welded to the back side of the face panel 1. Each wave-like metal binding strip 2 has two welding points welded to the back side of the face panel 1 and defining with the back side of the face panel 1 an open space 21 between its two welding points. When installed, each wave-like metal binding strip 2 has two opposite ends protruding over top and bottom sides of the face panel 1. The M-shaped metal binding strip 3 has its two ends and the middle part 31 of its bottom side welded to the back side of the face panel 1 between the wave-like metal binding strips 2 and defining with the back side of the face panel 1 two open spaces 32. The binding frame 4 comprises two curved quadrilateral frame portions 41 linked together and having a common side, and a rod portion 42 intersecting the common side of the quadrilateral frame portions 41 in the middle. The six angles (two of which are common angles of the quadrilateral frame portions 41) and two ends of the rod portion 42 are welded to the back side of the face panel 1 and spaced between the M-shaped metal binding strip 3 and one wave-like metal binding strip 2, defining with the back side of the face panel 1 seven open spaces 43.

Referring to Figures from 9 to 13 and FIG. 8 again, the face panel 1 with the welded wave-like metal binding strips 2, M-shaped metal binding strip 3 and binding frame 4 are put in the cavity of the mold and attached to the sand core 5 by securing the wave-like metal binding strips 2 to two vertical locating grooves 51 of the sand core 5, and then molten aluminum alloy is poured into the cavity of the mold and molded into a club head casing 6 on the face panel 1. When casting, molten aluminum alloy fills up the grooves 51 of the sand core 5 and the open spaces 21;32;43 and the endless groove 11 of the face panel 1. After casting, two ribs 61 are formed at the club head casing 6 and the wave-like metal binding strips 2 are embedded in the ribs 61 of the club head casing 6. Because a part of the club head casing 6 fills up the open spaces 21;32;43 and the endless groove 11 of the face panel 1, the face panel 1 and the club head casing 6 are fixedly secured together. After casting, an aluminum cover plate (not shown) is welded to the club head casing 6 and covered on its top opening 62.

Because the face panel 1 and the club head casing 6 are integrally molded together, the club head thus obtained has a smooth outer surface. Therefore, it is not necessary to grind the club head. Furthermore, because the wave-like metal binding strips 2 are welded to the face panel 1 and form a part of the ribs 61 of the club head casing 6, the club head has a strong structural strength to bear a high impact force.

Figure 14:
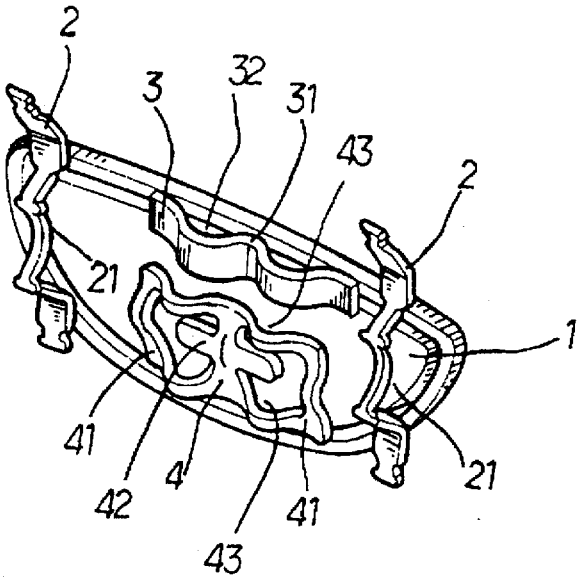
FIG. 14 shows an alternate arrangement of the present invention.

FIG. 14 shows an alternate arrangement of the present invention, in which the M-shaped metal binding strip 3 and the binding frame 4 are horizontally welded to the back side of the face panel 1 in at different elevations and spaced between the wave-like metal binding strips 2.

It is to be understood that the drawings are designed for purposes of illustration only, and are not intended as a definition of the limits and scope of the invention disclosed.

What the invention claimed is:

1. A face panel mounting structure for a golf club head, comprising a face panel having a back side and an endless groove at said back side around a border thereof, two wave-shaped metal binding strips and an M-shaped metal binding strip and a binding frame respectively welded to the back side of said face panel and molded with said face panel on a casing for a golf club head, wherein:

each of said wave-shaped metal binding strips having two welding points welded to the back side of said face panel and defining with the back side of said face panel an open space between said two welding points, and two opposite ends protruding over top and bottom sides of said face panel;

said M-shaped metal binding strip having two ends and a middle part thereof welded to the back side of said face panel between said wave-shaped metal binding strips and defining with the back side of said face panel two open spaces;

said binding frame comprising two curved quadrilateral frame portions linked together and having a common side, and a rod portion intersecting the common side of said quadrilateral frame portions in a middle thereof, said linked quadrilateral frame portions having six angles, the six angles of said quadrilateral frame and two ends of the rod portion of said quadrilateral frame being welded to the back side of said face panel and defining with the back side of said face panel seven open spaces.

* * * * *